United States Patent [19]

Pullen et al.

[11] 4,373,319

[45] Feb. 15, 1983

[54] RECORD BAGGING

[75] Inventors: Geoffrey J. Pullen, Hayes; John A. Pemberton, New Denham; Colin J. Brown, London, all of England

[73] Assignee: EMI Limited, Hayes, England

[21] Appl. No.: 176,592

[22] Filed: Aug. 8, 1980

[30] Foreign Application Priority Data

Aug. 18, 1979 [GB] United Kingdom ..... 7928834

[51] Int. Cl.[3] ..... B65B 5/04; B65B 43/14; B65B 43/44; B65B 43/54

[52] U.S. Cl. ..... 53/573; 53/266 A; 53/386; 53/570

[58] Field of Search ..... 53/266 A, 384, 386, 53/570, 571, 573; 493/123-125, 256; 271/30 R, 106, 11, 14

[56] References Cited

U.S. PATENT DOCUMENTS

| | | | |
|---|---|---|---|
| 2,384,506 | 9/1945 | Thompson | 53/266 A |
| 2,723,775 | 11/1955 | Von Hofe et al. | 271/14 |
| 3,075,324 | 1/1963 | Burks et al. | 53/384 X |
| 3,701,232 | 10/1972 | Parker | 53/386 X |
| 4,064,674 | 12/1977 | Palmer | 53/573 X |
| 4,149,356 | 4/1979 | Palmer | 53/386 X |
| 4,178,097 | 12/1979 | Sara | 271/11 X |

FOREIGN PATENT DOCUMENTS

| | | | |
|---|---|---|---|
| 1950089 | 4/1971 | Fed. Rep. of Germany . | |
| 1269170 | 4/1972 | United Kingdom . | |
| 1283522 | 7/1972 | United Kingdom | 53/571 |
| 1377264 | 12/1974 | United Kingdom . | |
| 1396504 | 6/1975 | United Kingdom . | |
| 1476627 | 6/1977 | United Kingdom . | |

*Primary Examiner*—John Sipos
*Assistant Examiner*—Charles L. Willis
*Attorney, Agent, or Firm*—Fleit & Jacobson

[57] ABSTRACT

A bag holding arrangement for disc record sleeves comprising, a plate whose lower surface is profiled to conform substantially to one side of an open bag. The lower surface of the plate is provided with suction means so that in operation the upper side of the bag is held against the surface, the lower side of the bag being unsupported and allowed to hang naturally. A system incorporating the bag holding arrangement is also described.

5 Claims, 9 Drawing Figures

Figure 1:
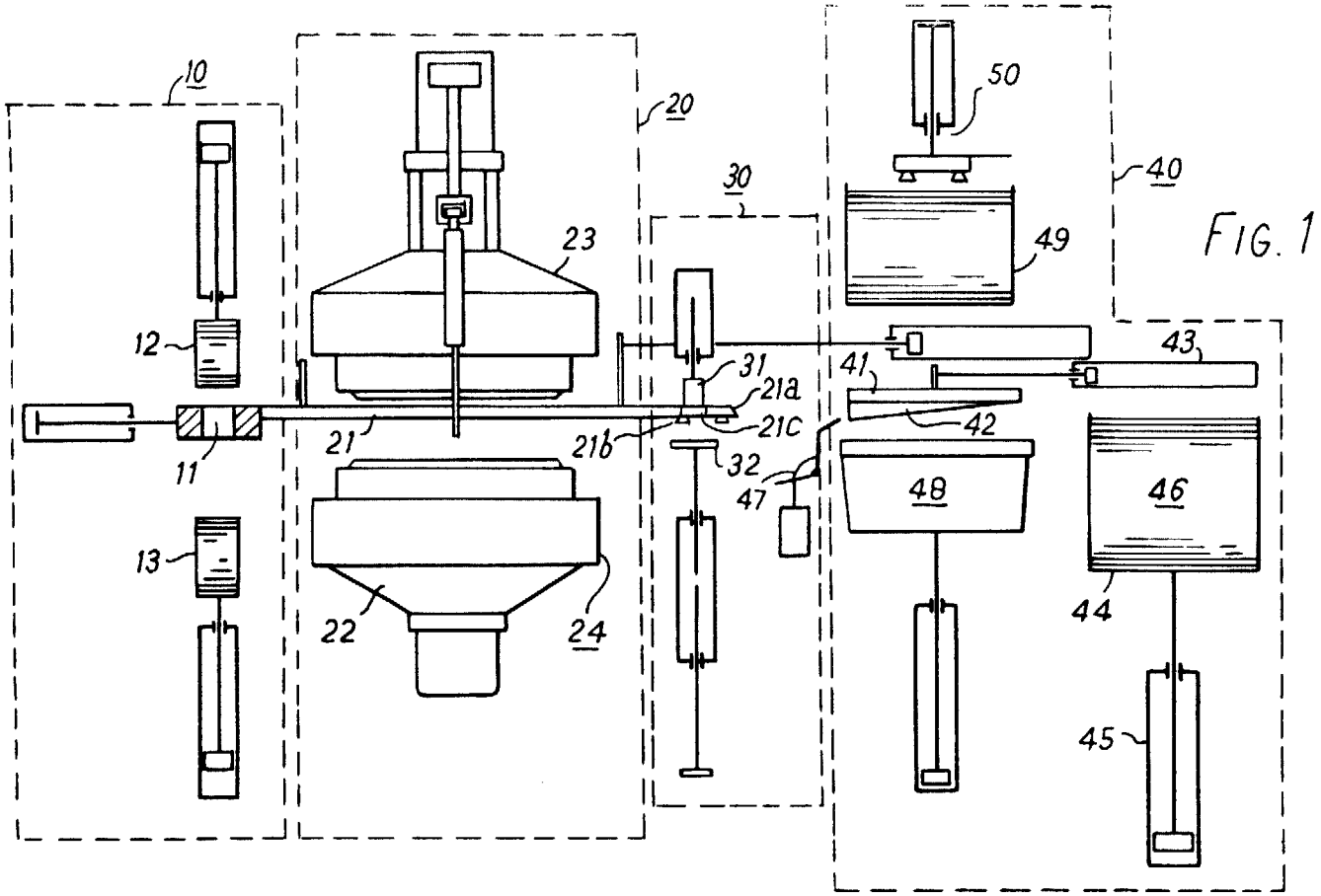

40
43
46
44
45
49
50
42
48
41
47
30
31
21a
21c
32
20
23
21b
24
21
22
10
12
11
13

Fig. 6
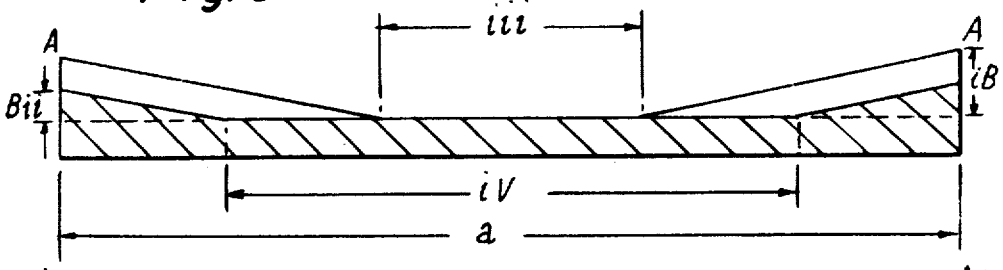
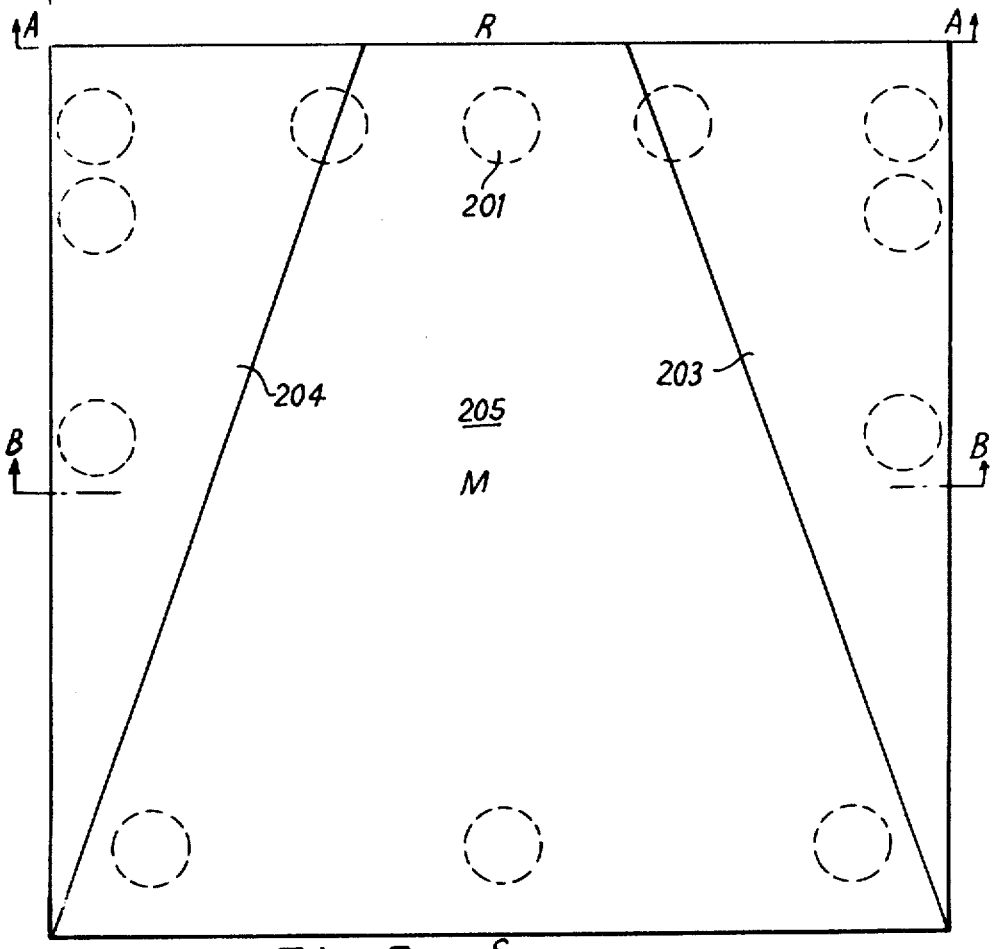
Fig. 5

RECORD BAGGING

This invention relates to record bagging arrangements.

The stages which comprise the production and packaging of plastics disc records, typically those of shot formation, disc pressing, flash trimming, and record bagging, are typically performed at the respective stations of an automatic pressing system of the type described, for example, in our U.K. PS No. 1,396,504.

These stations are usually arranged along a common horizontal axis and are linked by reciprocating sleds which transfer the output from one station in the production line to the next with as little delay and manipulation as possible.

To achieve a fast and economical production cycle it is desirable that the number and complexity of operations in each stage should be kept to a minimum and as far as is practicable no one operation should impose an undue limitation on any other operation.

A problem encountered at the bagging stage is that of separating the upper and lower sides of a bag so that a disc record may be inserted therein, and this is particularly difficult to achieve when the bag is made of a relatively light weight material such as paper or a plastics material.

In a number of bagging arrangements which have been devised, e.g. U.K. PS No. 1,377,264 and U.K. PS No. 1,269,170, it is necessary to rotate the record and bag into a substantially vertical position in order to complete an insertion and whilst this technique achieves the desired object it tends to be wasteful both in terms of space and production time.

It is, therefore, an object of the present invention to provide an improved form of bagging arrangement.

According to one aspect of the invention there is provided an apparatus suitable for use in a record transfer press for holding a record bag in a substantially horizontal position suitable for insertion therein of a disc record transferred thereto by a record transfer means, said apparatus comprising a plate means adapted to hold a bag so that the lower side thereof is everywhere unsupported and is spaced apart from the upper side, wherein the lower surface of the plate has suction means, said plate defining an axially extending channel having a first record receiving end and a second opposite end and having a progressively varying depth from said first end to said second end, the shaping being such that when the upper side of a bag is caused by the suction means to conform to the lower said surface the shortest distance between the opposed closed edges of the bag is greater than the diameter of the disc record to be inserted therein, the other, closed edge of the bag being accommodated at or close to the end of the channel of least depth.

The channel may have obliquely angled sides or alternatively may have a substantially parabolic cross-section.

The arrangement may also include a reciprocatable blade positioned adjacent to the end of the channel having the greater depth for insertion into the mouth of a bag held open by the said plate.

According to another aspect of the invention there is provided a record bagging system including an apparatus of the above-described kind and also comprising means for inserting a disc record into a bag held open in a substantially horizontal position by said apparatus at a bagging location, a bag storage means remote from the bagging location, respective first and second reciprocatable means for causing relative vertical and lateral movement of said apparatus and the storage means to thereby transfer an empty bag to the said apparatus, and a collection means for receiving a filled bag.

One part of said reciprocatable means may cause lateral movement of said apparatus and another part of said reciprocatable means may cause vertical movement of the bag storage means.

Figure 4:
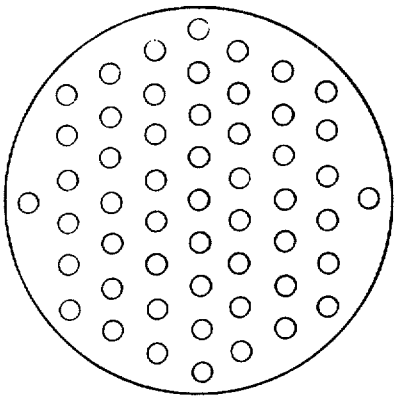
Figure 2:
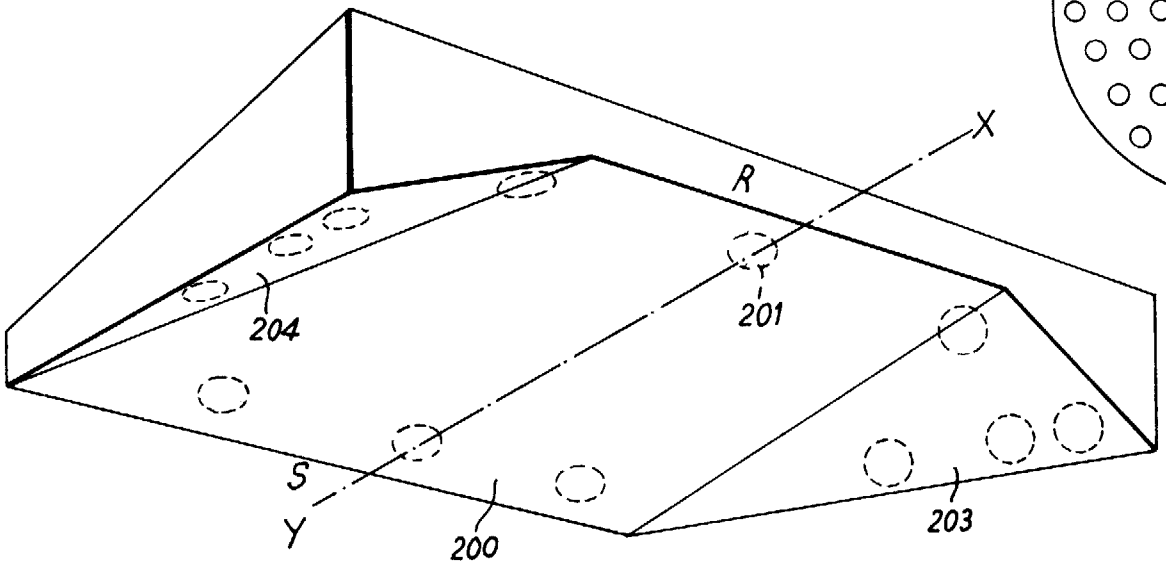
Figure 3:
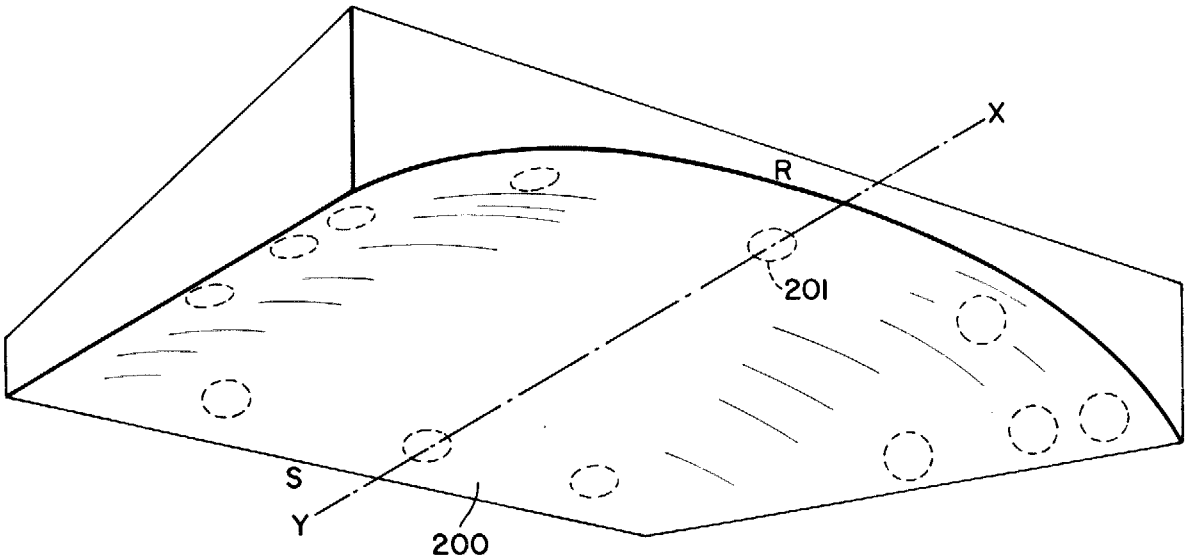
Figure 7:
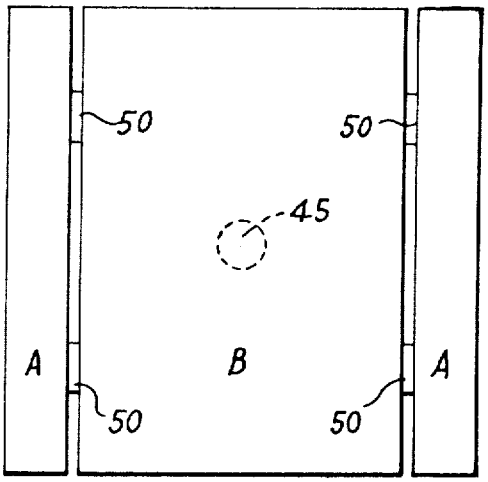
Figure 8:
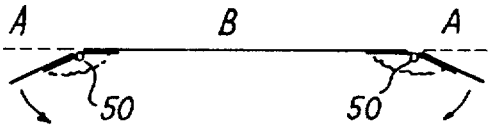
Figure 9:
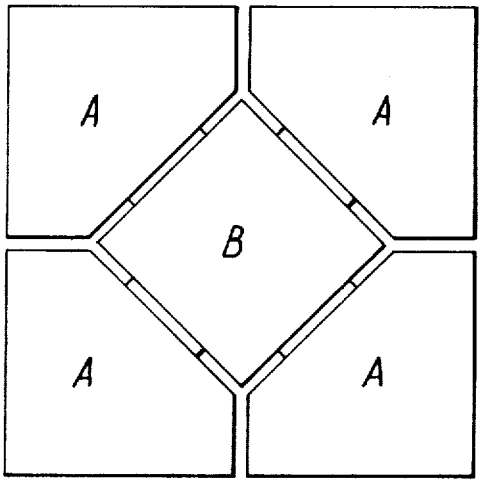

In order that the invention may be more readily understood a specific embodiment is now described by way of example only with reference to the accompanying drawings of which, FIG. 1, illustrates a schematic side view of an automatic record press, FIGS. 2 and 3 illustrate perspective views of the bag holding means having respectively angled and parabolically shaped channels, FIG. 4 shows an enlarged view of a suction port, FIG. 5 illustrates the plan view of the bag holding means, FIG. 6 illustrates the sectional views AA and BB of the bag holding means, and FIGS. 7, 8 and 9 illustrate two alternative forms of base plate used in the bag storage means.

FIG. 1 of the drawings illustrates a schematic side elevation view of an automatic record pressing system.

The four basic work stations which comprise the system, namely the shot forming station, the record moulding station, the flash trimming station and the record packaging station are respectively enclosed within the boxes 10, 20, 30 and 40.

During the first stage in the production of a disc record a "shot" of molten plastics material is extruded into a closed cavity, 11, and labels from the magazines, 12 and 13, are respectively applied to the upper and lower surfaces of the formed shot. A typical shot forming and labelling arrangement is described, for example, in our U.K. PS No. 1,396,504. The shot which is formed at station, 10, is transferred by a main sled, 21, to a position between the rams, 22 and 23, of a press, 24, in readiness for moulding. At the same time the sled, 21, also transfers the previously moulded disc to the flash trimming station, 30, and similarly a freshly trimmed record is transferred by the sled to the record packaging station, 40.

During the trimming stage a pair of reciprocating clamps, 31 and 32, cooperate to hold the untrimmed disc firmly in the horizontal plane, but permit it to rotate about a vertical axis in response to the action of the cutter wheels of the flash trimmer. The cutter wheels themselves are not shown in FIG. 1 but a typical arrangement is described, for example, in our U.K. PS No. 1,476,627.

The main sled, 21, has a wedge shaped end piece, 21*a*, whose lower surface is provided with suction pads at 21*b* which lie directly above the centre of the disc record (i.e in the region of the upper record label) during the flash trimming operation. The end piece, 21*a*, has a centrally positioned aperture, 21*c*, through which the upper clamp, 31, may be lowered prior to trimming, in order to hold the record centrally against the lower clamp, 32. When the trimming operation has been completed, however, clamp, 31, is retracted and suction is applied by the pads, 21*b*, which causes the record to be held against the lower surface of the end piece in a substantially horizontal plane. The record is then transferred to an open bag which is held by a bag holding means, 41, in substantially the same horizontal plane. As described above, particularly when paper or plastics bags are used a problem encountered in bag handling arrangements known hitherto has been that of sufficiently separating the upper and lower sides of the bag so that a disc record may be fully inserted therein. As described, for example in UK PS No. 1,377,264 and U.K. PS No. 1,269,170 it has hitherto been necessary to rotate the bag holder into a substantially vertical position so that insertion of a record is essentially completed by the agency of gravity.

In the present invention the bag holding means, 41, comprises a substantially horizontal square plate, 42, whose lower surface is shaped so that it approximates to the upper side of an open bag (i.e. the plate has an axially extending channel). Suction means are provided at this surface so that a bag applied thereto is held in the open condition (i.e. the upper and lower sides of the bag are completely separated) so that in cross-section the bag assumes a lentilised shape, the lower side being unsupported. The plate, 42, is maintained in the horizontal plane by means of a further reciprocating sled, 43, and the design of the plate and in particular the profile of the lower surface is now described by reference to FIGS. 2, 3 and 4.

FIG. 2 shows a perspective view of the plate, as seen from below. The bag holding surface is shown at 200 and circular suction ports which lie in the plane of the surface are shown at 201. An enlarged view of a suction port is illustrated in FIG. 4, and as will be apparent to a person skilled in the art ducts (not shown in FIG. 2) connect each port to a common pumping arrangement.

As can be seen from FIG. 2 the lower surface, 200, of the plate is not planar. It is formed with sloping side portions, 203 and 204, which define a shallow channel of varying depth running along the central axis, XY. The depth of the channel is greatest at the record receiving end, R, (i.e. the end facing the trimming station). The end, R, accommodates the open end of the bag into which the record is initially inserted. The end, S, on the other hand accommodates the closed end of the bag and so the depth of the channel decreases, in this case linearly, from a maximum at R, to zero at S. The form of the plate is shown in greater detail in the scale drawing of FIGS. 5 and 6.

A plan view of the lower surface of the plate is shown in FIG. 5. The plate is 304 mm square and as shown in the drawing, has 12 suction ports, each 26 mm in diameter disposed around its periphery. As shown in the enlarged view of FIG. 4 each port is comprised of 53 holes, each 1.5 mm in diameter, and whose centres are spaced by 3 mm. The plate itself is made of hardened aluminium and is shown in cross-section in FIG. 6. The record receiving end R of the plate is shown in the cross sectional view AA of FIG. 6 and the section BB shows the cross sectional view, BB midway between the ends, R and S.

As will be appreciated from the drawings the sides of the channel, represented by regions 203, and 204, are obliquely inclined to the horizontal base, 205, of the plate. At the record receiving end, R, the channel has a depth, (i), of 22 mm and at the mid position, M, the depth, (ii), is only 11 mm. The corresponding distances, (iii), and (iv), between the intersection of the sides with base of the plate, are respectively 84 mm and 194 mm.

A bag transferred to the plate is caused by the suction means to conform to the shaped lower surface thereof, the shortest distance between the closed edges of the bag being nowhere less than the diameter of the disc record to be inserted therein (30 cms in this case). Since the lower side of the bag is allowed to hang naturally under the influence of gravity the complete separation of the upper and lower sides permits the full insertion of a record.

While the above described example relates to a plate whose lower surface has obliquely angled sides, other channel arrangements may be preferred. In particular the lower surface of the plate may have a substantially concave, axially extending, channel which in vertical section perpendicular to the axis of the channel may be parabolic (FIG. 3).

In operation of the bag handling arrangement shown in FIG. 1, during the periods of shot formation, moulding, and flash trimming, the bag holding means 41, is moved by the sled, 43, laterally away from the trimming station, 30, to a bag collection position directly above a bag storage means, 44. A reciprocating piston, 45, then causes the storage means, 44, to be raised so that its sides encompass the bag holding means. When the uppermost bag in stack, 46, engages the lower surface of the holding means, suction is applied, thereby effecting transfer of a bag. The storage means then returns to its rest position and the holding means, 41, together with the bag are returned to the record receiving position shown in FIG. 1 in readiness to receive a disc record transferred thereto by the main sled, 21. A reciprocating blade, 47, may also be inserted into the mouth of the held bag to ensure the separation of the sides.

As will be apparent to a person skilled in the art the movements of the reciprocating sled, 43, are carefully coordinated so that the collection of an empty bag is completed before the transfer of a record is initiated by the movement of the main sled, 21. When the record has been transferred, however, the sled end piece 21*a* is withdrawn and the filled bag is released and falls into a collection box, 48, positioned directly below the record receiving position. An aluminium spacer disc is transferred from a reservoir, 49, by a suction and piston arrangement, 50, and is placed in the collection box at five record intervals.

Particularly when paper or plastic bags are used the profiles assumed by the uppermost bags in the store, 44, tends to be substantially concave. This is due to the greater thickness at the closed edge of each bag which causes the stack to "fan" out. To ensure that, despite this fanning, the uppermost bag in the store engages the profiled lower surface of the holding plate, the base plate of the store, 44, may be adapted in the manner shown in FIG. 7 or 9. Referring firstly to the plan view of FIG. 7, the central region, B, is attached to the piston, 45, and the peripheral regions, A, of the base plate are hinged and are biased by resilient springs, 50, against movement out of the horizontal plane. When the bag store is raised the uppermost bag in the stack first contacts the peripheral regions of the lower surface of the bag holding means. The regions, A, of the base plate are depressed and caused to move out of the horizontal plane, as shown in the end view of FIG. 8, until such time as the bag fully contacts the holding means. Suction applied at the lower surface of the holding means, as described above, is then sufficient to retain the bag in the held position, and the store is retracted and the base plate again assumes a horizontal configuration. The arrangement shown in FIGS. 7 and 8 comprises three elements, the central element, B, which always assumes a horizontal position, and to either side of B, the hinged members, A. In the present arrangement the element, B, extends along a direction parallel to the axis of the channel in the lower surface of the bag holding means. In an alternative arrangement of FIG. 9, however, there are four, symmetrically disposed, hinged, peripheral members, A.

The present invention provides improved arrangements for packaging records and whilst the described arrangement relates to the packaging of a 30 cm disc record, it will be appreciated that other arrangement, encompassed by the invention, may be adopted for use with other record sizes.

What we claim is:

1. An apparatus suitable for use in a record transfer press for holding a record bag in a substantially horizontal position suitable for insertion therein of a disc record transferred thereto by a record transfer means, said apparatus comprising a plate means adapted to hold a bag so that the lower side thereof is everywhere unsupported and is spaced apart from the upper side, wherein the lower surface of the plate means has suction means, said plate means defining an axially extending channel having a first record receiving end and a second opposite end and having a progressively varying depth from said first end to said second opposite end, the shaping being such that when the upper side of a bag is caused by the suction means to conform to the lower said surface the shortest distance between the opposed closed edges of the bag is greater than the diameter of the disc record to be inserted therein, the other, closed edge of the bag being accommodated at or close to said second opposite end.

2. An apparatus according to claim 1 wherein the channel has obliquely angled sides.

3. An apparatus according to claim 1 wherein the channel has a substantially parabolic cross-section.

4. An apparatus according to any one of claims 1, 2 or 3 including a reciprocatable blade positioned adjacent to the end of the channel having the greater depth for insertion into the mouth of a bag held open by the said plate.

5. A record bagging system including an apparatus according to any one of claims 1, 2 or 3 which system also comprises means for inserting a disc record into a bag held open in a substantially horizontal position by said apparatus at a bagging location, bag storage means remote from the bagging location, respective first and second reciprocable means for causing relative vertical and lateral movement of said apparatus and storage means thereby to transfer an empty bag to said apparatus, and collection means for receiving a filled bag.

* * * * *